US011124353B2

(12) United States Patent
Maier-Eschenlohr et al.

(10) Patent No.: US 11,124,353 B2
(45) Date of Patent: Sep. 21, 2021

(54) INSULATION PACKAGING FOR THERMAL INSULATION AND/OR SHOCK ABSORPTION MADE FROM STRAW AND/OR HAY

(71) Applicant: LANDPACK GMBH, Puchheim (DE)

(72) Inventors: Thomas Maier-Eschenlohr, Puchheim (DE); Patricia Eschenlohr, Puchheim (DE)

(73) Assignee: LANDPACK GMBH, Puchheim (DE)

( * ) Notice: Subject to any disclaimer, the term of this patent is extended or adjusted under 35 U.S.C. 154(b) by 687 days.

(21) Appl. No.: 15/117,942

(22) PCT Filed: Feb. 6, 2015

(86) PCT No.: PCT/EP2015/052507
§ 371 (c)(1),
(2) Date: Aug. 10, 2016

(87) PCT Pub. No.: WO2015/121167
PCT Pub. Date: Aug. 20, 2015

(65) Prior Publication Data

US 2016/0355320 A1 Dec. 8, 2016

(30) Foreign Application Priority Data

Feb. 11, 2014 (DE) ..... 202014001280.6

(51) Int. Cl.
*B65D 81/38* (2006.01)
*B65D 65/46* (2006.01)
(Continued)

(52) U.S. Cl.
CPC ..... *B65D 81/3848* (2013.01); *B65D 5/5028* (2013.01); *B65D 65/466* (2013.01);
(Continued)

(58) Field of Classification Search
None
See application file for complete search history.

(56) References Cited

U.S. PATENT DOCUMENTS 3,664,076 A * 5/1972 McCoy ..... E04B 1/161 52/264
4,956,140 A * 9/1990 Rolles ..... B29C 43/22 264/280

(Continued)

OTHER PUBLICATIONS

Bolcu, Mechanical Properties of Composite Materials Reinforced with Wheat Straw, 2010, Materiale Plastice, 47 nr. 2, p. 219 and 223 (Year: 2010).*

*Primary Examiner* — Matthew J Daniels
*Assistant Examiner* — Andrew L Swanson
(74) *Attorney, Agent, or Firm* — TIPS Group

(57) ABSTRACT

The invention relates to a method for producing an insulating packaging for thermal insulation and/or shock absorption, and a packaging of this type. According to the invention, straw or hay or a mixture of the two is plasticized; the plasticized straw and/or hay is subjected to moulding; while maintaining the moulding, the plasticization is reversed and the straw and/or hay is hardened without material bonding between the individual stalks of straw and/or hay; and the straw and/or hay is provided with a coating on all sides. By this means, an insulating packaging is created consisting of one or more insulating cores (1) made of pressed straw and/or hay and at least one coating (2), wherein the insulating core (1) is designed to be dimensionally stable and providing the shape without bonded connection between the individual stalks of hay and/or straw, and the insulating core (1) is completely surrounded by a coating (2) which is only connected by interlocking without additional connecting elements with the insulating core (1).

19 Claims, 1 Drawing Sheet

Figure 1:
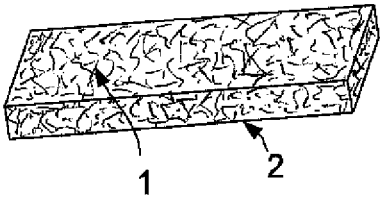

(51) Int. Cl.

| | |
|---|---|
| ***B65D 81/127*** | (2006.01) |
| ***B65D 5/50*** | (2006.01) |
| ***B65D 81/03*** | (2006.01) |
| ***B65D 81/113*** | (2006.01) |

(52) U.S. Cl.
CPC ..... *B65D 81/03* (2013.01); *B65D 81/113* (2013.01); *B65D 81/127* (2013.01); *B65D 81/3897* (2013.01)

(56) References Cited

U.S. PATENT DOCUMENTS

| | | | | |
|---|---|---|---|---|
| 2002/0113340 | A1* | 8/2002 | Reetz | B27N 3/00 264/320 |
| 2007/0045456 | A1* | 3/2007 | Medoff | B29B 17/0042 241/24.29 |
| 2009/0077920 | A1* | 3/2009 | Korman | B29C 43/06 52/606 |
| 2009/0188642 | A1* | 7/2009 | Pittman | B27N 7/005 162/201 |
| 2014/0021651 | A1* | 1/2014 | Martins | B29C 43/003 264/322 |

* cited by examiner

INSULATION PACKAGING FOR THERMAL INSULATION AND/OR SHOCK ABSORPTION MADE FROM STRAW AND/OR HAY

For the storage and shipment of temperature sensitive goods, insulation packaging is required to ensure that the temperature inside the packaging does not fall below or does not reach predefined limits. Such packagings are mainly used for pharmaceutical products, medical products and food.

Exceeding these temperature limits, often regulated by law, poses a high financial risk for the consignor and a health risk for the recipient.

To create the insulation effect for an insulation packaging the three heat transfer phenomena convection, conduction and thermal radiation must be minimized. Air is an ideal insulation medium due to its low thermal conductivity and availability. The changes in density of air at different temperatures causes the movement of air (convection), this can be reduced by restricting the movement of the air. Thermal radiation can be reduced by the selection and arrangement of suitable materials.

These aforementioned factors of heat transfer typically restrict insulation packagings to being a bulky, hollow body of many small air chambers. Regular shipment with these bulky packagings not only leads to a large disposal problem with the end customers but also poses ecological issues with increased online trading.

An easy to dispose of, shock absorbent, environmentally friendly insulation packaging is the key factor for consumer acceptance of the growing online grocery market. The standard insulation packaging is typically made from expanded polystyrene (EPS). EPS provides a good insulation effect, the ability of freeform shapes and is low cost due to high volume production. However the production of insulation packagings made from EPS is very energy intensive. The environmental impact from the contained contaminants (flame retardants, styrene, plasticizers and pentane) is controversial. The humidity in an EPS box reaches between 80%-90% from cooling elements and as such moisture sensitive products, for example bakery products, can be damaged.

Alternative insulation packaging has been developed to meet the demand for a more environmentally favorable and easier to dispose of insulation packaging.

In literature there are examples of insulation packaging based on starch foam. For example, a composite material based on starch foam is disclosed in EP0656830B1. The production of starch foam is energy intensive and therefore costly. Due to the moisture sensitivity an impenetrable water and vapor barrier is required. This means that like EPS, no humidity regulation can take place. For these reasons, no starch based products have been successful in establishing themselves on the market.

There exists insulation packaging composed of inflatable air cushions, such as disclosed in US005533888A. This insulation packaging is made up of a network of interconnected layers in aluminum plastic films and provides sufficient insulation performance. They are however, susceptible to mechanical damage in which all of the insulation effect is lost and owing to the complicated manufacturing process, are considerably more expensive than comparable EPS packaging. In addition, they are made of conventional plastic and must be disposed of as residual waste. As with EPS, no humidity regulation is provided.

In the construction industry the use of plants and plant materials (hemp fibers, straw, hay, etc.) for insulation has been known for some time and has recently established itself as a niche product for building insulation. Therefore two different classifications of the materials are used: plant derived fibers as well as plants or plant components (such as leaves, stems or stalks) in their raw form.

Fibers obtained from plants are processed further by mechanical, chemical and thermal processes for nonwovens. The plant fibers are often expensively derived from hemp, flax or linen. The process corresponds to the textile nonwoven production. Nonwovens are defined according to DIN EN ISO 9092:2012-01 as a sheet made from fibers, continuous filament yarns or cut yarns. Only approximately 20-30% of the plant can be used as fiber. These thin fibers are not able to take compression but only tensile forces. For mechanical stabilization they must therefore be made into sheets by compaction, bonding and/or felting. For further mechanical stabilization the nonwovens are usually combined with additional layers by quilting, riveting or bonding. The use of nonwovens as insulation packaging is therefore complex and expensive. In addition the nonwovens are difficult to unravel again and as such disposal must be carried out as a whole. A free form design is not possible. The nonwovens are always made into larger plates and mats.

An insulation packaging material is for instance disclosed in EP0644044A1. A natural fiber fleece is sandwiched between two cover sheets made from a biodegradable film. In DE19846704C2 a two sided laminate mat of hemp for the building industry is disclosed. It is characterized by the filling which is formed from unroasted hemp which is composed of a mixture of long fibers, short fibers and shives. To ensure stability and prevent setting of the mat quilting seams, rivets or an integrated mesh are necessary.

In EP1840043B1 a three-dimensional packaging element made of natural fibers with a reduced amount of binders is disclosed. The product shall replace packaging elements, which so far are made out of pulp in a wet process. The packaging element is made by hot pressing of a nonwoven airlaid fluff material with high pressure. The nonwoven material is made of fine natural fibers, which by adding water form hydrogen bindings in between the fibers. Additionally added adhesives and/or supporting fibers bond the composite by hot pressing. The amount of adhesives can be reduced, if the natural fibers still contain lignin, which leave the fibers during hot pressing and bond the fibers together. Hot pressing under high pressure leads to a fine surface finish. Furthermore, a sandwich-structure is described where the packaging element is equipped with a layer e.g. out of plastic, on the top side and on the bottom side. Hot pressed packaging elements are used for instance as egg cartons or other packaging moldings. Due to the finely digested fibers high pressure and/or adhesives must be applied in order to reach mechanical stability. The described two-sided lamination also serves as functional surface. Typically thus manufactured products have a thin wall thickness (few millimeters), high density on average and are therefore not appropriate as insulation packagings.

Largely unprocessed components of plants such as leaves, stems or stalks are usually bound with a binder to be made into insulation panels. In DE19810862C2 for example, an insulation panel made from straw for the construction industry is described. The insulation board consists of a homogeneous mixture of chopped straw and a binder (10-30%). On both sides a lattice grid is glued on. These boards which are bonded with a binder are expensive to produce and can be difficult to manually separate. The smooth surfaces of the straw require a special chemical or mechanical treatment to have good bond strength. An ecologically beneficial composting is also problematic with the use of a plastic binder.

In EP1958762B1 a natural fiber fleece made of straw and other natural fibers with a matrix of PLA is described. Through the influence of temperature the PLA fibers melt and thus form a natural fiber composite material. By compression molding at an elevated temperature one layer of a hybrid non-woven fabric is then produced which can be surrounded in a PLA foil. The PLA foil can already be included in the pressing process. These resulting moldings can be used as a packaging material or in several layers as wall elements. The natural fiber fleece consists of about 35% of expensive PLA bioplastic and is therefore not competitive with polystyrene.

In EP0570018B1 a packaging from pressed straw or hay is shown in which no additional binder or adhesive takes place. Due to the strong compression of soaked or treated straw or hay a smooth packaging member shall be created such as a container or a box. Due to the strong pressing the surface is smooth and printable.

Manufacture of such packaging pieces made from plants and without binders is generally known. It is achieved by high pressures and temperatures as shown in EP1377418B1 or DE202009013015U1. The aim is to utilize the natural binders in the plants, such as the biopolymer lignin, as adhesives. This means that external adhesives are not required as the plants natural elements are used. It is possible to produce free formed packaging. Due to the high pressures required to produce the packaging piece there is barely any air cavities present and therefore cannot have suitable insulation performance. The result is a solid, press-bonded body, which can no longer be separated. A shock-absorbing effect is also not available.

To reduce the cost of bonded insulation for the construction industry, it is proposed in DE8536156U1 to enclose an unbound network of straw with two paper sheets and then threading at small intervals for mechanical fixing. This fixing has the disadvantage that the panel is difficult to separate. Therefore they must be disposed of as a whole. Also only large panels can be formed in this way and free shaping is not possible. Since the insulation panel is not sealed on all sides, unfixed pieces of straw or dust can be easily detached. Such insulation panels are therefore not suitable for use as insulation packaging as they would contaminate or damage the concealed objects.

In DE4333758A1 and DE4317239A1 an insulating mat from a biomass such as straw for the construction industry is disclosed. The biomass is preferably stitched, glued or needled and is equipped with flame retardant. A material for packaging in which untreated biomass is loosely filled in a net is also mentioned. Nets stuffed with biomass are not stable in shape without the reinforcement of quilting or riveting and as such. They also exhibit a non-uniform density distribution which is not appropriate for insulation considering the large voids. Possibly they can be used as filler material.

In JPH10287370 (A) a padding material made of straw for shock-absorption is disclosed. The forming is reached by quilting the straw and by bonding with a covering.

As of yet no plant based insulation packaging has been able to prevail in the market. The solutions developed for the construction industry from plants or plant fibers are not suitable for insulation packaging considering the underlying requirements are fundamentally different. Insulation used as building materials are fire-retardant, pest resistant and mechanically prepared in a way, that they achieve satisfactory insulating performance even after decades. For example settling by gravity over decades must be prevented. Such complex and expensive materials are not suitable to be used for insulation packaging. In addition such materials are difficult to crush and discard. Generally the narrow edges of insulation plates for the construction industry are not concealed as the plates are contained within walls or beams and thus. Components of these insulating materials can break off and contaminate products being shipped. For modern insulation packaging materials it is also important to allow free form shapes to allow for the varied requirements of the packaging market. Existing plant based insulating materials without binders are only possible in plate forms, free shaping is not possible.

Due to the afore-mentioned disadvantages of plant based insulating materials and insulation packagings from prior art, the market has been unable to establish any environmentally friendly alternative to EPS.

The objective of the claimed invention is therefore to produce an insulation packaging for temperature-sensitive and/or shock-sensitive products which has economic advantages to the established EPS packaging, excellent insulation and damping effects, improved environmental performance, a simplified disposal and the ability for free form shapes. The insulation packaging must also meet the strict requirements for the shipment of food. They should be suitable as a single use, disposable packaging. Furthermore, a method for manufacturing such insulation packaging is to be created.

This objective is accomplished according to the present invention by an insulation packaging according to claim 1 and a method for producing the insulation packaging according to claim 15th. Advantageous further developments are described in the dependent claims.

As raw material hay or straw is used in either monomaterial, a mixture or in components. The mixture can be made up of different straw or hay varieties as well as the mixture of hay and straw. Straw is used as the collective term for dried stalks, stems and leaves of cereal crops, oil crops, fiber crops and legumes. Hay is used as the collective term for dried fodder plants such as herbs, grasses or legumes.

Straw or hay from sweet grass is particularly advantageous as the stalks are hollow and do not involve marks. The diameter of the stalks is ideally between 1 mm and 10 mm. In this way the stalks in their small interior air chambers prevent convection within the straw itself.

Cereal straw from barley is particularly advantageous as it is available at low cost, has a low tendency for fungal attack and has excellent insulating properties. Cereal straw is created in large quantities as an agricultural by-product and when ⅓ is taken from the field, can be used without any ecological disadvantage. When considering regional availability other straw or hay species may be more advantageous.

FIG. 1 shows a simple view of the invention in the form of an insulation packaging which consists of an insulation core (1) and a covering (2). The function of the insulation core (1) is to reduce the conduction and convection as much as possible. Air is used as the insulating medium considering its low thermal conductivity of 0.0267 W/mK. However because of the temperature dependent density of air there is considerable heat transfer by convection. To prevent this, the air must be restricted as much as possible in its movement. In its original condition cereal straw has a density of approximately 20 kg/m$^3$. In this form the stalks of straw sometimes form large cavities of several centimeters and as such free convection significantly reduces the thermal insulating effect. The insulation core according to claim 1 has an adjustable density of 40-250 kg/m$^3$. The cavities in such an insulation core are smaller than 0.5×0.5×0.5 cm$^3$ whereby convection is largely excluded. The density must be adapted to the requirements of the goods to be packed. When taking into account the material consumption an optimal insulating effect is achieved at around 60-80 kg/m$^3$. With this density the thermal conductivity is comparable to polystyrene's 0.043 W/mK. For shock absorption of heavy objects a density of around 250 kg/m$^3$ is ideal whereas around 40 kg/m$^3$ is better for lighter, more fragile articles. The thickness of the insulation core is theoretically not limited however a thickness of 1 cm to 15 cm has proven to be advantageous for the applications listed here.

The insulation core (1) consists of an arrangement of hay and/or straw with the hay or straw stalks having a length from 0.5 cm to 50 cm. It has proven advantageous to use a mixture of different lengths. The short pieces are arranged so that a uniform density distribution occurs within the insulation core. Thus a uniform insulating effect is achieved while blocking the channels for convection. For example, barley and wheat straw has proven particularly advantageous with 1 cm to 25 cm lengths. Undamaged hay and straw pieces can be used. But the use of current harvesters always inflicts some damage to the stalk structure however this is not required.

It has proven particularly advantageous if the straw and hay stalks are orientated predominately (>80%) perpendicular to the heat flow of the insulation core. The heat flow from a hot side to a cold side of the insulation core is significantly lower when the heat must travel against the longitudinal side of the straw and hay.

Figure 3:
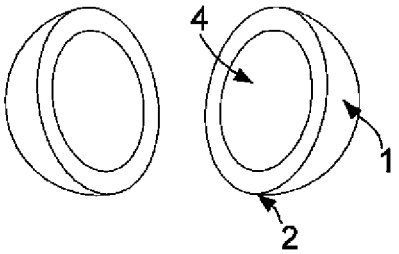
Figure 4:
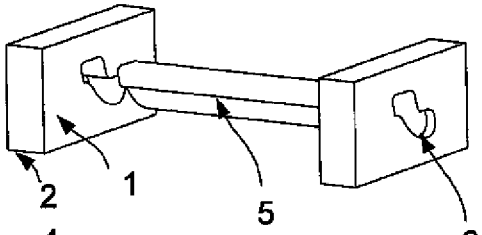

The structure of the insulation core is so pronounced that by taking advantage of the natural buckling strength (absorbing forces in the longitudinal direction) any shape such as holes, convex/concave surfaces, undercuts, sharp edges, etc. are possible (FIG. 1, FIG. 3, FIG. 4). This is necessary to be able to adjust common forms of packaging such as shell elements, crates, boxes or trays to the requirements of the packaged product. The shape retention of the insulation core can be maintained without externally supplied adhesives or inherent plant binders. The stems and stalks do not need to be connected by means of substance-to-substance bonding. The shape retention also requires no mechanical fasteners. The straw or hay is also not separated further into its structural components such as fibers or shives. Only by leaving the straw or hay intact, the plants natural buckling resistance is unaffected, which is needed for the shape retention of the insulation core. In the prior art the plant fibers used can no longer resist compressive forces and as such must be used in compacted or bonded nonwoven materials to achieve compressive strength.

Binders are understood here as all additives, which due to their mechanical, physical or chemical interaction with the straw and/or hay of the insulation core have an impact on the shape retention of the insulation core or the insulation packaging (for example tensile strength, dimensional stability, compressive strength, resilience behavior). Binders used from prior art are typically polymer fibers, adhesives (e.g. starch, alkali silicates, latex, resin), bicomp fibers, thermosetting resin or thickeners. Additives, which would modify the characteristics of the straw and/or hay in a way that the plant materials would act as binders themselves, are also understood as binders here. By supplying chemical additives the lignin of the plants can for example by modified in a way that it bonds without mechanical pressure. Binders can be added to insulation materials for different reasons. From prior art, starch or their derivates are used as binders but also as means for hydrophobising.

Mechanical fasteners are understood here as macroscopic elements, which can impact on the shape retention of the insulation core or the shape retention of the insulation core together with the covering by friction-locking and/or form-locking. This includes for example quilting, riveting, lamination or the introduction of nonwovens or nets. Mechanical fasteners can also be added to insulation materials for other reasons, for example only for optical reasons.

According to the present invention no binders or mechanical fasteners are necessary for the shape retention of the insulation core with or without covering. The form-locking and friction-locking between the individual straw and/or hay stalks and between the covering and the insulation core are sufficient. Nevertheless, it can be reasonable for different reasons to add binders or mechanical fasteners even if they are not mandatory. It might be reasonable for example for optical reasons, commercial reasons, hydrophobising reasons or in order to smooth surfaces, to improve the printability or to specifically influence mechanical characteristics.

Shape retention of the insulation core and the insulation core together with the covering is understood here as capability of those to withstand external stress (e.g. forces, temperature, air humidity) to such a degree, that handling during the production steps as well as the intended use of the product are possible.

The insulation core can withstand pressure loads very well without experiencing permanent deformation. For example, with a load of 10 N/cm$^2$ applied for 1 minute on a 60 kg/m$^3$ insulation core made from barley straw a spring back of 95% occurs. Once the external pressure is removed the insulation core returns to its original starting shape without appreciable setting.

As the straw and/or hay insulation core is not mandatorily bonded together, dust particles and plant material may be deposited sporadically. For this reason the insulation core is surrounded in a flexible covering. It is sufficient to link the insulation core with the covering only by form-locking. There is no need for mechanical fasteners such as threads, rivets, as well no binders are necessary to connect the covering with the insulation core. This means that the covering can be easily detached from the insulation core and disposed of separately if needed. The covering also provides important functional properties on the surface.

The covering can be made from plastic, paper, cardboard, organic plastic (e.g. PLA), a natural or artificial nonwoven, starch (foamed or non-foamed) or similar materials. For plastic films a thickness of 10 μm to 500 μm has proven to be suitable. Coverings made from paper, cardboard or cellulose are more suited to a thickness of 30 μm to 5 mm. The desired layer thickness depends on the expected external loading as the insulation core does not exert force on the covering.

When the covering is vapor permeable it is particularly advantageous as it enables humidity regulation within a packaging container. This can be achieved by suitable material selection or by perforating a normally sealed covering. When using insulation boxes made from EPS the humidity increases within the package to more than 80%. Moisture sensitive products are particularly prone to damage. If the relative humidity increases for instance from 50% to 80%, the straw and/or hay insulation core is able to absorb around 10% of its own weight in water and as such can restrict an increase in relative humidity. An insulation core with a mass of e.g. 1 kg may absorb that way up to 100 ml of water.

The covering can also be made from a food grade material such that direct contact with food is possible.

If the covering is from a transparent material the insulation core made from straw and/or hay becomes visible. This can be noted, especially in the food industry, as an aesthetic advantage.

The covering can also be odor-inhibiting or antibacterial.

To further increase the insulation effect it is advantageous for the covering to be partially or entirely made from low emissivity materials, preferable aluminum. Thus the covering absorbs and emits a lower amount of heat radiation. The aluminum can partially or entirely be vaporized or may be laminated in the form of films or composite films. The aluminum thickness should be at least 40 nanometers for an effective shield.

A particular advantage of the invention is the possibility of all available disposal options. If no binder is used, or a biodegradable binder is used, the insulation core can be disposed of in on-site compost or the regional bio-waste. It can also be used in the garden or for animals. If the covering is selected from a non-biodegradable material it can be easily removed from the core and disposed of separately. The high heat value of straw (3.8 kWh/kg) and pollution free, carbon neutral combustion mean that energy recovery from the straw is also reasonable. Typically the legal framework for waste management differs greatly between regions. The end user is open to all means of disposal, from which they can choose the most convenient. A cumbersome disposal at a recycling center can be avoided. Due to the use of inexpensive materials and simple disposal options, the inventions insulation packaging is ideally suited for disposable use.

Below five other exemplary embodiment are described.

Figure 2:
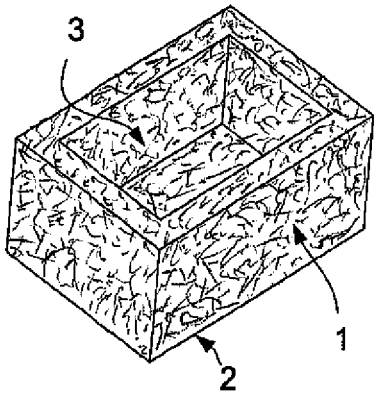

In FIG. 2, an exemplary embodiment is shown in which the insulation packaging consists of a one piece insulation core (1) with a cellophane covering (2) and forms a cubic cavity (3) for receiving cargo.

In FIG. 3, an exemplary embodiment is shown in which the insulation packaging consists of two hollow shells. The outer surface is convex shaped and the inner side (4) forms a concave cavity. The two insulation cores (1) are enclosed in a covering (2) made of opaque paper.

In FIG. 4, another exemplary embodiment is shown in which an insulation packaging consists of two covered insulation cores (1) with a hollow inner structure (6) which is used to store sensitive subject matter (5) to protect it from shocks. The insulation cores have a density of 130 kg/m$^3$. The covering (2) consist of 200 μm thick paper.

Figure 5:
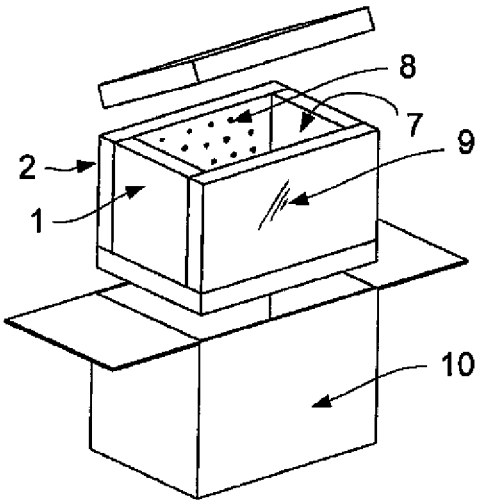

In FIG. 5 another exemplary embodiment is shown in which the insulation packaging consists of six plate shaped insulation cores (1) which have a density of 80 kg/m$^3$. These form a cubic hollow space (7). The insulation cores are wrapped in a food-grade covering (2) which is made from 15 μm thick plastic (PET/PE/PET). The coverings have perforations (8) so that the moist air from inside the box can pass into the insulation cores. The outwards facing surfaces of the insulation packaging are vapor-coated with a 50 nanometer thick aluminum layer (9) which acts to reflect heat radiation. The insulation packaging can be used for shipment in a standard cardboard box (10).

Figure 6:
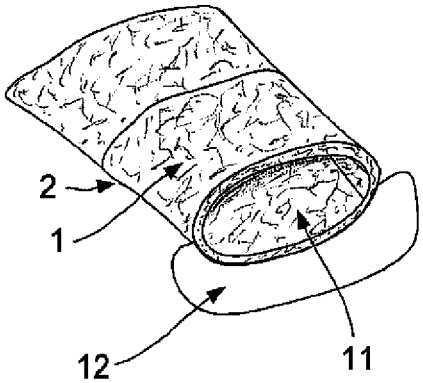

In FIG. 6 a further exemplary embodiment is shown in which the insulation packaging has an elliptical, pocket-like shape that has only one side open (11). Through this opening objects which require cooling may be introduced. The covering (2) is made of a biodegradable plastic, preferably PLA, with a thickness of 20 μm. The insulation core (1) has a density of 60 kg/m$^3$. A self-adhesive strap (12) is used to close the insulation packaging.

Method Description

The manufacturing of the insulation plate according to the described exemplary embodiment contains the following steps:

1. Clean the straw and/or hay;
2. Chemical treatment of straw and/or hay;
3. Mechanical treatment of straw and/or hay;
4. Mixing different straw and/or hay batches;
5. Disinfecting straw and/or hay;
6. Dosing of straw and/or hay;
7. Plasticizing of straw and/or hay;
8. Shaping of straw and/or hay;
9. Cooling of straw and/or hay while maintaining the shape;
10. Dry the straw and/or hay;
11. Product-specific mechanical processing;
12. Casing of the straw and/or hay with a cover.

Each individual step is explained and possible modifications are also described. Further modifications are possible in which the sequence of steps is modified or even omitted under certain circumstances.

Step 1

The straw used is usually in the form of pressed round or square bales. Uncut straw and/or hay is advantageous as a starting raw material as the structural properties of the straw and/or hay can be modified to meet the requirements. Stalk length varies depending on the variety from between 20 cm and 100 cm. An optimal ratio of length to diameter is less than 300:1 and greater than 5:1. The thickness of the stalks may be between 0.1 mm and 15 mm. Straws with a thickness of 0.1 mm to 5 mm are particularly ideal. The mechanical processing on the field can lead to shorter stalks and dust in the bales.

The straw and/or hay bales are mechanically separated and sent to a mechanical cleaning process. The mechanical cleaning takes place with the use of a separator which is designed as centrifugal, gravity, magnetic separator, sieve, zigzag sifter, filter or a combination of these. Mechanical cleaning can be carried in wet or dry condition. The mechanical cleaning removes dust, stones, lumps and other undesirable components.

Step 2

A chemical treatment can be carried out for the purpose of further purification as well as for introduction of pesticides, fungicides, preservatives, disinfectants or other auxiliaries. Through chemical processing, degreasing, loosening, adsorbing, absorbing, drying, etching, bleaching, or coating may be achieved. Further auxiliaries can be for example glue, resin, paraffin, wax, fillers, colorants, fibers or other binders. Mechanical fasteners such as particles, fibers, nets, etc. can also be introduced.

For example the introduction of electrochemically activated water (ECA) at a concentration of 0.1% to 20% in aqueous solution is beneficial. Especially ideal is a concentration of 0.1% to 2% ECA dissolved in water. It is furthermore advantageous to dose the thus prepared ECA solution with 0.1%-20% by weight to the straw and/or hay. It is especially advantageous to use a dosing ratio of 0.5% to 12% by weight. With the application of ECA a pre-disinfection of straw and/or hay takes place. In addition, all parts of the plant which come into contact with the treated straw and/or hay are disinfected. The risk of cross-contamination can be reduced, the cleaning intervals of the plant can be extended.

In an exemplary embodiment, an aqueous solution of ECA is produced with a concentration of 5%. With the help of an atomizer, the ECA solution is continuously misted into a flow of hay and/or straw, so that the ratio of the mass of ECA solution and hay and/or straw is 3:100. In another exemplary embodiment, a commercially available anti-bacterial and anti-fungal agent is sprayed into the straw and/or hay, which increases the durability of the insulation core in adverse storage conditions.

The chemical removal of the wax layer on the straw and/or hay can also help to improve in the adsorption of water. With a water vapor-permeable covering, the moisture-regulating effect of insulation packaging can thus be increased.

By treating the straw and/or hay with a pH reducing substance for aqueous solutions, a natural antibacterial effect can be generated in the event that the straw and/or hay gets wet in later use. In addition, the effectiveness of subsequent disinfection can be increased. The pH value beneficially reduces in the wet state (at 20% moisture level) to a value of 5.5 or lower, whereby numerous bacteria are prevented from growth. Advantageous is for instance the treatment of straw and/or hay with lactic acid with a ratio of 0.5% to 3% by weight.

Bleaching may be applied whereby the visual appearance of the straw and/or hay can be improved. For example the straw and/or hay will be lightened in color and impurities due to sooty mold will be removed.

With the application of odor inhibitors such as soda the odor of the straw and/or hay can be eliminated. With the insertion of flavors or fragrant plants the packaging can be made fragrant. Parts of for example mint, lavender or roses can be added to the straw and/or hay. This can also be done for pure optical reasons.

The chemical treatment may take place at any time in the process, depending on the requirements and method of treatment.

Steps 3 and 4

Straw and hay are natural products which may be subject to certain natural variations in their quality and properties. This depends on the climatic conditions during growth and harvest, the soil, the type of equipment used, the plant varieties and the storage conditions. To be able to produce an insulation core of consistent quality and properties, or to improve on existing properties, it may be necessary to mechanically, chemically or biologically process the straw or hay.

In addition, it can be useful to blend straw and/or hay types which also may have experienced different processing.

Examples of mechanical processing that can be used include, slitting, transverse cutting, squeezing, compressing, grinding or rubbing.

The mechanical processing has significant influence on, among others, the following parameters:

Density
Insulation performance
Water adsorption
Mold-filling properties
Flow behavior
Young's modulus for tensile and flexural rigidity
Tensile strength p Coefficient of friction In an exemplary embodiment, uncut barley straw with a stalk length of 50 cm is cut perpendicularly with a knife with a first batch of 25 cm length and a second batch of 5 cm. Both batches are mixed with a weight ratio of 50:50 and blown into a silo for further processing. During production, if the produced insulation core has too low tensile strength the weight fraction of 25 cm stalks can for example, be increased to 65%. The longer stalks bring greater tensile strength to the insulation core. However at the same time the risk of defects in the insulation core is increased. This is because the stiff barely stalks displace adjacent smaller stalks and introduces voids. Defects in the insulation core are areas where in a radius of 2.5 mm no straw and/or hay is present. In voids, heat transfer takes place by convection, which impairs the insulation effect of the insulation core. The risk of defects increases with decreasing density of the insulation cores. Densities of 40 $kg/m^3$ to 65 $kg/m^3$ are particularly susceptible to defects.

In another exemplary embodiment, uncut barley straw with a stem length of 45 cm is cut perpendicularly with a knife at 15 cm lengths and mixed with 40 cm long soft uncut oat straw at a weight ratio of 30:70. With the soft oat straw, the outer shape of the insulation core adapts very well during the pressing process. The high stem length of the oat straw ensures a good tensile strength, while the stiffer barley straw increases the flexural strength of the insulation core. If larger insulation cores are produced, the flexural strength of the insulation cores can be increased by raising the proportion of barley straw to a weight ratio of 50:50.

In another exemplary embodiment, uncut wheat straw with a stem length of 60 cm is processed with a splitting machine. This cuts the straws in the longitudinal direction and then places another cut perpendicularly for a length of 15 cm. The very rigid straw becomes more bendable and can be further processed in a mixture or in pure form. Other, very rigid straw and/or hay can thus be adapted to the requirements for a specific bending stiffness.

In another instance, 30 cm long cut barley straw is continuously crushed by a profiled pair of rollers with which the spacing can be varied. The bending strength at the point of crushing is greatly reduced, while the tensile strength of the resulting insulation core is nearly unaffected.

Step 5

Volume or weight measurement can be used for the dosing of straw and/or hay. Since the volume of straw and/or hay is highly dependent on the variety or mechanical processing, a weight measurement is preferable. A volume measurement is beneficial if the straw and/or hay is to be discharged onto a continuous conveyor belt, as this can be implemented with less effort. With volume measurement, it is advantageous when the produced insulation core is weighed and the target volume input adjusted accordingly. Dosing can be undertaken at any time prior to molding. It is ideal to perform the dosing at least after the mechanical cleaning, since in this case considerable amounts of straw and/or hay is discarded.

Step 6

Natural raw straw and hay is heavily colonized with microorganisms. Typically after delivery, the total number of germ-forming units per gram (CFU/g) is $5\text{-}10^6$, which consists mainly of bacteria and fungi. To be used as a packaging material, the germ count should be reduced by several orders of magnitude and pathogenic bacteria should not be detectable. For the disinfection of straw or hay all conventional methods are suitable in principle. Thus, irradiation, fumigation, use of liquid disinfectants or a heat treatment is possible. Moist heat has proven to be particularly advantageous. The straw and/or hay is treated with superheated steam, saturated steam or wet steam at ambient pressure or elevated pressure. Under saturated or wet steam conditions temperatures of 90° C. to 150° C. have been found to be appropriate with an ideal range from 95° C. to 130° C. The duration of treatment depends on the desired reduction of microbial count and is heavily dependent on the actual steam temperature. In 100° C. saturated steam, a treatment time of 3 minutes has been shown to be particularly suitable. With an increased pressure of 3 bar and 130° C. steam temperature a few seconds can fulfill the needs for adequate disinfection.

Step 7

Straw and hay consist primarily of cellulose, lignin and hemicellulose. The individual plant constituents such as the cell wall or middle lamella are composed mainly of these materials in different structural compositions. The lignocellulose, which forms the cell walls of woody plants, is a composite structure in which the cellulose and the hemicellulose form a framework incorporated by the lignin. While the cellulose and hemicellulose absorb tensile forces the lignin absorbs compressive forces. The composite is therefore comparable to a reinforced concrete construction.

It is known that lignin can be plasticized by heat. With an increase in humidity, the glass transition temperature of the lignin is lowered. With cooling below the glass transition temperature the lignin hardens again. The procedure is largely reversible. In the dry state (8% moisture level) the glass transition temperature is 130° C.-180° C. and in the wet state about 80° C.-90° C.

The glass transition temperature of hemicellulose and cellulose is also strongly dependent on humidity. In the wet state, the glass transition temperature drops even to room temperature. The straw and/or hay is plasticized by the application of moist or dry heat. The biopolymers lignin, cellulose and hemicellulose are heated above their glass transition temperature. The effect of moist heat lowers the glass transition temperature of lignin. The straw and/or hay must be heated to at least 80° C. A moisture content of 5%-25% is desirable, depending on the straw or hay type. For barley straw, the optimum moisture content is 8%-20%.

Moisture can be introduced prior to heating of the straw and/or hay or be introduced simultaneously with the heating. So there are two alternatives: using damp straw and/or hay or dry straw and/or hay.

If dry straw and/or hay should be plasticized with moist heat, steaming with steam (saturated steam or wet steam) is particularly ideal. The hot steam causes a temperature increase of the straw and/or hay as well as humidification due to adsorption. Water vapor has a much higher internal energy (enthalpy) than air at the same temperature. As such the heating is particularly effective. At the same time, the thermal conductivity is dramatically increased by the introduced moisture, so that a particularly rapid heating is possible. The temperature of the steam should be in the range of 90° C. to 150° C. For steam temperatures above 100° C., the vapor deposition is carried out under pressure to comply with the saturated or wet steam conditions. For a steam temperature of 130° C., for example, a pressure of 3 bars is required. An increased pressure accelerates adsorption of water significantly in the straw and/or hay. The process time can therefore be significantly reduced with higher pressure.

Plasticizing of 0.25 kg of barley straw at 98° C., ambient pressure and 8 kW of steam generation results in a process time of 5 seconds. The barley straw takes up about 18 grams of water. The moisture content increases from 8% to 14.7%.

If damp straw and/or hay is to be plasticized by moist heat, steam (wet steam or saturated steam) can also be used for heating in the temperature range from 90° C. to 150° C. However, it is particularly beneficial in this case to only heat the existing moisture in the straw and/or hay instead of increasing the moisture further. Suitable heating can be achieved with hot air flowing through, microwave radiation, by contact heating, by superheated steam or a combination of these. Especially advantageous is the use of superheated steam, as it has a very high internal energy and high thermal conductivity, allows for an uniform heating, and as such the process time can be made very short. A temperature of superheated steam from 101° C. to 150° C. at ambient pressure is suitable. Superheated steam at a temperature of 102° C. to 130° C. is ideal.

The heating of damp straw and/or hay may also be accompanied by simultaneous drying whereby water vapor is removed. In this case, the shaping process should take place before plasticization. The moisture in the straw and/or hay prevents breakage of the straw and/or hay at low compression.

Step 8

After plasticization in step 7, the shaping of the straw and/or hay takes place. At room temperature moist or dry straw and/or hay have a very good resilience and cannot form without the use of binders. Only with very high pressures associated with high temperatures can the straw and/or hay form solid compacts. The excellent insulating properties of straw and hay is largely lost during such processing. In contrast, after the plasticizing of straw and/or hay, described in Step 7 of this invention, the resiliency is almost completely removed. This means that even small force, from 0.1 to 10 $N/cm^2$, on the straw and/or hay is sufficient for shaping. Especially ideal is a force of 0.1 $N/cm^2$ to 2 $N/cm^2$. The shaping can, depending on the process design, take place before or after the plasticizing of straw and/or hay.

The shaping is divided into the inner and outer shaping:

Outer shaping is understood here as the temporary or permanent fixation of the straw and/or hay in an at least partially deterministic defined shape. The outer shaping determines at least in part the outer contour of the straw and/or hay after shaping. The outer shaping is inventively done by at least partial molding of geometrically defined objects, by subtractive or additive shaping processes such as cutting, stamping, etc. or by the action of fluids or gases.

The inner shape is understood here as a temporary or permanent fixation of the straw and/or hay in stochastically defined shape, whereby the influence of physical properties of the composite of straw and/or hay stalks is in the foreground. For example, it determines the stochastic distribution of straw and/or hay inside the outer shape or the nature, frequency and quality of form locking and frictional locking between the hay and/or straw parts. The inner shape may be influenced by the nature of the external shaping, by exposure to fluids, gases and by geometrically defined or undefined geometric objects.

For example, the external shaping can form the straw and/or hay into sheets, blanks and freeform bodies each with or without notches. The inner shaping can for example evenly distribute the straw and/or hay, locally accumulate, hook, layer or arrange the stalks of straw and/or hay.

In an exemplary embodiment, 25 cm long barley straw is blown pneumatically into a rectangular chamber with dimensions of 30×30×30 $cm^3$. The barley straw is thereby distributed so that the weight per unit area in the edge region is 2.4 $kg/m^2$ and towards the center decreases to 1.2 $kg/m^2$. The height of straw in the chamber is approximately 12 cm at the edges and 6 cm at the center. Additionally, the stalks are aligned in the preferred direction, parallel with the chamber. Nevertheless, the stalks of straw and/or hay are still three-dimensionally entangled with each other. The volume of the chamber is reduced by a rectangular piston to 30×30×2 $cm^3$. The density of the straw and/or hay is increased to 120 $kg/m^3$ in the edge region of the chamber and 60 $kg/m^3$ in the middle. No voids greater than 0.5×0.5×0.5 $cm^3$ are present in the material. The insulation core is now defined in its inner and outer shape, but is not mechanically stable due to the ongoing plasticization of the straw and/or hay.

Step 9 and 10

After shaping, the defined internal shape needs to be stabilized. Stabilization can be achieved by bringing the lignin in the straw and/or hay below their glass transition temperature. The cellulose and hemicellulose do not necessarily need to be brought below their glass transition temperature for stability. This allows for a particularly advantageous feature of the invention such that the resultant insulation core is still moist but enough stable in shape to be dried in a second step. The glass transition temperature of the lignin can be undershot by cooling or drying or by a combination of cooling and drying. When the inner shape is stabilized, automatically the outer shape is too.

For example, cooling can be carried out by common methods using cold gases, such as air or nitrogen, by evaporative cooling, or by contact cooling with cold solids. Drying can be performed by all conventional methods, such as hot-air drying, vacuum drying, superheated steam drying, microwave drying or a combination of these methods.

Drying with superheated steam at 101° C. to 150° C. and a pressure of 0-5 bar above ambient pressure proved to be advantageous. This method is particularly effective considering the high heat transfer means the process time can be reduced. To improve efficiency, it is possible to overheat the water vapor after it has passed through the straw and/or hay and to then recirculate it.

Drying with superheated steam at 102° C. to 120° C. and 0 to 1 bar above atmospheric pressure has proven particularly beneficial.

Introducing air into the superheated steam in quantities of 1%-50% has proven advantageous, because the drying time is further reduced. An aeration of 1%-20% has proven ideal.

The insulation core gets its shape retention to a sufficient degree by form-locking and/or friction-locking between the straw and/or hay stalks. Substance-to-substance bonding with binders or further form-locking and/or friction-locking connections with additional mechanical fasteners are not necessary for the shape retention of the insulation core. The addition of binders can however be advantageous for other reasons, for example for the hydrophobising of the insulation core.

In an exemplary embodiment, in accordance with step 7, straw and/or hay is plasticized under moist heat with saturated steam and thereby brought to a moisture level of 20% and a temperature of 95° C. While retaining the shape, ambient air is blown at a flow rate of 1 m/s through the moist, hot straw and/or hay until the temperature of the straw and/or hay is 50° C. The resulting insulation core has a residual moisture level of 15% after cooling and is stable in shape.

In a further exemplary embodiment, in accordance with step 7, straw and/or hay is plasticized under moist heat with saturated steam and thereby brought to a moisture level of 20% and a temperature of 95° C. Subsequently superheated steam (120° C., ambient pressure) with an introduction of 20% air and a flow rate of 1 m/s is blown through the moist, hot straw and/or hay, until the moisture level of the straw and/or hay is 8%. The resulting insulation core has a temperature of 97° C. and is stable in shape.

Step 11

The insulation core manufactured from steps 1-10 can be further processed with other mechanical methods. For example, cutting, punching, pressing, stacking, or joining is possible. Insulation cores can also be combined to form one larger insulation core.

Step 12

One or all of the produced insulation cores according to the steps 1-11 are cased in the last step with one or several coverings. It is especially advantageous to use only the form-locking of the covering to connect it with the insulation core and no to use mechanical fasteners such as quilting, riveting as well as no binders. This allows the covering of insulation core to be disconnected when needed and simply discarded. The use of mechanical fasteners and/or binders to connect the covering with the insulation core can be reasonable for optical reasons or to specifically influence mechanical characteristics.

The covering can be made of plastic, paper, cardboard, organic plastic (eg. PLA), natural or artificial nonwoven, starch (foamed and not foamed) or the like. The covering may be applied to the insulation core in a solid, liquid or pasty state. Through treatments such as drying, curing, cross-linking, bonding, welding, crimping, shrinking, wrapping or the like, the shape of the covering can be customized to the outer shape of the insulation core. Especially beneficial is a tight enclosure on all sides, as this protects and stabilizes the insulation core particularly well. The covering may also be printed or coated in various ways, and be composed of more than one of the previously-mentioned components.

In an exemplary embodiment, the insulation core is first covered with a PLA film and the PLA film is subjected to a heat treatment for shrinkage in which the PLA sheet conforms to the outer shape of the insulation core. Several such insulation cores are then placed in a box so that all the sides of the boxes are covered with insulation cores and the edges are overlapping.

In another exemplary embodiment, the insulation core is inserted into a similar size cross bottom bag made of craft paper and then sealed by a self-adhesive flap.

Under some circumstances it may be advantageous for the straw and/or hay to be introduced into the covering before or during shaping (step 8). In this case the shaping will be performed together with the cover. For example, straw and/or hay can be put into a covering of a reinforced cellulose nonwoven and then plasticizing (step 7) and shaping (step 8) is performed.

The described method for producing an insulation packaging may be either continuous, batch or a mixture of the two. Below, two examples are given for a production plant:

Exemplary embodiment for method—discontinuous:

First, the mechanical loosening of straw in a bale opener takes place. The straw is cut in a cross cutter to 15 cm in length. A suction machine is removing dust from the straw. A material transport blower is feeding the straw to a gravity separator and then into a silo. There the straw is sprayed with a dosage amount of 1% of the straw weight of 1% concentrated ECA aqueous solution. From the silo straw is discharged onto a conveyor belt scale until a target weight of 260 grams is achieved. The portion of straw is conveyed via a material transport blower into a cup-shaped mold and is there evenly distributed, so that 80% of the straw stalks are oriented substantially parallel to the base of the mold. The straw is treated within the mold for 2 minutes at 98° C. with saturated steam. This step disinfects and plasticizes the straw simultaneously. The straw experiences an increase in the humidity level from 8% to 17%. Then the straw is compressed by a cup-shaped stamp in its density of 30 kg/m$^3$ to 80 kg/m$^3$. For this purpose, a low pressing pressure of 0.1 N/cm$^2$ is applied. Then superheated steam of 120° C. is flowed through the slightly compressed straw under ambient pressure until a moisture level of 8% is reached. This process takes about 30 seconds. Thereafter the now finished insulation core is ejected. In this produced state the insulation core is stable in shape for some time. Sharp edges, radii and large areas can be replicated precisely. After brief cooling, the insulation core is put into a 20 μm thick PLA film and the PLA film is then subjected to heat shrinkage. The film shrinks to perfectly fit the insulation core. As such the insulation packaging is completed.

Exemplary embodiment for method—continuous:

First, the mechanical loosening of straw in a bale opener takes place. The straw is cut in a cross cutter to 15 cm in length and conveyed into the silo 1. In a second step, the loosening of hay in a bale opener takes place. The hay remains in the original length of about 30 cm and is conveyed into the silo 2. A suction takes place to remove the dust of straw and hay in the silos. The straw and hay is discharged from the silos with conveyor belt scales and pneumatically mixed at a ratio of 50%. Then the straw/hay mixture is supplied with a material transport blower into a third silo. The straw/hay mixture is discharged in a uniform height of 25 cm on a continuously moving conveyor from the silo 3. Then the straw/hay mixture passes through a steam tunnel for 3 minutes with saturated steam (100° C., ambient pressure) in which it is disinfected and plasticized. A moisture content of 18% in the straw/hay mixture is established. This is followed by a compression of the straw/hay-mixture through a converging belt press, wherein the belts of the belt press are equipped with a three-dimensional diamond profile so that areas of higher density and areas of lower density are formed. A cold airflow (20° C., ambient pressure) is streamed through the belts of the press. Thereby the straw/hay mixture is cooled to 45° C. and hardens. The thus produced straw/hay mixture is stable in shape and has a moisture content of 15%. Then, the straw/hay-mixture is fed to a belt dryer which reduces the moisture content from 15% to 8% in the run. For this purpose warm air (75° C.) flows through the straw/hay mixture. From the so produced core insulation panels are cut out by longitudinal and transverse cutting, which are form-locking inserted in a covering made of kraft-paper.

The invention claimed is:

1. A method for manufacturing an insulation packaging for heat insulation or shock absorption comprising:

plasticizing lignin of a material including a mixture of at least one of stalks of straw or hay without the addition of an external binder with heat to form a plasticized material above a glass transition temperature of the lignin;

shaping the plasticized material with a lesser shaping force of between 0.1 N/cm$^2$ and 10 N/cm$^2$;

removing the plasticizing from the material by cooling below the glass transition temperature of the lignin while maintaining the shape of the material;

curing the material to form an insulation core having a density of 40-250 kg/m$^3$; and covering the insulation core on all sides with a covering.

2. The method according to claim 1, wherein the stalks are mechanically cleaned.

3. The method according to claim 1 wherein the stalks are treated with at least one of a pesticide, fungicide, preservative, disinfectant, cleaning agent or an aqueous solution of electrochemically activated water (ECA) in a concentration of 0.1% to 20% weight of the insulation core.

4. The method according to claim 1 wherein the stalks are at least one of partially dewaxed, lowered in pH value, bleached, treated with an odor-inhibiting substance, treated with an odor-causing substance, is processed mechanically or has a germ count reduced.

5. The method, according to claim 1 the stalks are at least one of processed chemically or mechanically before forming the mixture.

6. The method according to claim 1 wherein the mixture is plasticized by at least one of a moist heat or by a drying process.

7. The method according to claim 1 wherein the mixture is plasticized with overheated steam.

8. The method according to claim 1 wherein the mixture is unevenly compressed during the shaping process.

9. The method according to claim 1 wherein at least one of the insulation core is removed from a mold in a wet state or the insulation core is mechanically processed after the removal from a mold.

10. The method according to claim 1 wherein a plurality of insulation cores are joined or combined into a new insulation core.

11. The method according to claim 1 wherein the mixture is at least one of provided with the covering before shaping, during shaping, before plasticization or during plasticization.

12. The method according to claim 1 further comprising at least one of adding a binder to the stalks, adding a binder to the covering, adding a binder to the insulation core, and providing the covering with mechanical fasteners that are not necessary for the shape retention of the insulation core or the covering.

13. A method for manufacturing an insulation packaging for heat insulation or shock absorption comprising:

disposing a material including a mixture of at least one of stalks of straw or hay, in a mold such that a majority of the stalks are oriented substantially parallel to a base of the mold;

plasticizing lignin of the material with heat to for in a plasticized material above a glass transition temperature of the lignin;

shaping the plasticized material with a shaping force of between 0.1 $N/cm^2$ and 10 $N/cm^2$;

removing the plasticizing from the material by cooling below the glass transition temperature of the lignin while maintaining the shape of the material;

curing the material to form an insulation core having a density of 40-250 $kg/m^3$; and covering the insulation core on all sides with a covering.

14. The method according to claim 13 wherein at least 80% of the stalks are oriented substantially parallel to the base of the mold.

15. The method according to claim 13 wherein the shaping force is applied for 3 minutes or less.

16. A method for manufacturing an insulation packaging for heat insulation or shock absorption comprising:

plasticizing lignin of a material including a mixture of at least one of stalks of straw or hay with heat to form a plasticized material above a glass transition temperature of the lignin;

shaping the plasticized material with a shaping force between 0.1 $N/cm^2$ and 2 $N/cm^2$;

removing the plasticizing from the material by cooling below the glass transition temperature of the lignin while maintaining the shape of the material;

curing the material to form an insulation core having a density of 40-250 $kg/m^3$; and covering the insulation core on all sides with a covering.

17. The method according to claim 16 wherein the shaping force is provided by a converging belt press.

18. The method according to claim 16 wherein the shaping force is applied for 3 minutes or less.

19. The method according to claim 18 wherein the shaping force is applied for at least 30 seconds.

* * * * *